US008083369B1

(12) United States Patent
Richardson et al.

(10) Patent No.: US 8,083,369 B1
(45) Date of Patent: Dec. 27, 2011

(54) BRACKET FOR A LIGHTING FIXTURE IN A SUSPENDED CEILING

(75) Inventors: Ronald L. Richardson, Conyers, GA (US); Dallas I. Buchanan, III, Kentfield, CA (US); Juan C. Suarez, Marietta, GA (US); Thanh M. Vo, Riverdale, GA (US)

(73) Assignee: A.L.P. Lighting & Ceiling Products, Inc., Niles, IL (US)

( * ) Notice: Subject to any disclaimer, the term of this patent is extended or adjusted under 35 U.S.C. 154(b) by 420 days.

(21) Appl. No.: 12/436,863

(22) Filed: May 7, 2009

Related U.S. Application Data

(60) Provisional application No. 61/056,191, filed on Apr. 27, 2008.

(51) Int. Cl.
*F21V 21/00* (2006.01)
*F21V 15/00* (2006.01)

(52) U.S. Cl. ..... 362/217.11; 362/217.15; 362/365

(58) Field of Classification Search ..... 362/217.01, 362/217.11 –217.17, 364, 365, 366, 432, 362/249.01, 382, 403, 404, 408, 417, 418
See application file for complete search history.

(56) References Cited

U.S. PATENT DOCUMENTS

| | | | | |
|---|---|---|---|---|
| 2,973,177 | A * | 2/1961 | Stubbs | 248/343 |
| 4,419,717 | A * | 12/1983 | Price et al. | 362/148 |
| 4,716,504 | A | 12/1987 | Pahl et al. | |
| 4,814,954 | A * | 3/1989 | Spitz | 362/217.07 |
| 5,161,878 | A * | 11/1992 | Degelmann et al. | 362/150 |
| 5,521,804 | A * | 5/1996 | Degelmann et al. | 362/220 |
| 5,777,857 | A | 7/1998 | Degelmann | |
| 6,752,513 | B2 | 6/2004 | Plunk | |
| 7,338,182 | B1 | 3/2008 | Hastings et al. | |
| 7,614,770 | B2 * | 11/2009 | Lanczy | 362/375 |
| 7,914,176 | B2 * | 3/2011 | Stanley et al. | 362/285 |

* cited by examiner

*Primary Examiner* — Bao Q Truong
(74) *Attorney, Agent, or Firm* — Adam K Sacharoff; Much Shelist

(57) ABSTRACT

An adapter bracket which enables the installation of a door frame or louver into a recessed fixture that sits on a T-bar supported by a ceiling without having to custom design a hinge and latch system to match the original fixture or require the installation of a false frame that lifts the fixture. The brackets slide between the T-bar and the existing fixture. The bracket is also slightly wider than the T-bar opening. The door frame will keep the brackets spaced wide enough to ensure that the assembly would not fall out of the opening. The hinge and latch mechanism for the door frame is built into its end rails and latches onto the bracket to ensure the door frame is supported and held in position.

12 Claims, 6 Drawing Sheets

BRACKET FOR A LIGHTING FIXTURE IN A SUSPENDED CEILING

CROSS REFERENCE TO RELATED APPLICATION

This application claim priority and benefit to U.S. Provisional 61/056,191 filed May 27, 2008.

FIELD OF THE INVENTION

The present invention relates to light fixtures and more particularly to a new bracket used with a light fixture in a suspended ceiling.

BACKGROUND OF THE INVENTION

Conventional overhead recessed lighting fixtures or luminaries are designed to conform to suspended ceiling such that the lower edge of the fixture is nearly flush with the underside of the ceiling tiles. The suspended ceilings typically all have a common construction, using inverted T bars suspended from the permanent ceiling above via wires or other structures. The T-bars, which form the suspended ceiling, are laid out to define a grid structure with defined openings between the T-bars. The openings are sized to accommodate ceiling tiles. In addition to the ceiling tiles, lighting fixtures may also be supported by the T-bars.

As the industry advances there is a continual need to retrofit or upgrade existing fixtures with new optics. One problem is that some of the older model fixtures do not include a hinged louver or other type of door frame because the hinge and latch are built into the louver itself. Therefore, changing the louver to a new optic without changing the fixture itself becomes a difficult task as one cannot simply open a door frame and slide a new fixture in its place. This problem is addressed by one or more embodiments of the present invention.

SUMMARY OF THE INVENTION

To overcome this problem, one or more embodiments of the present invention provides for an adapter bracket which enables the installation of a door frame or louver into a recessed fixture that sits on a T-bar supported by a ceiling without having to custom design a hinge and latch system to match the original fixture or require the installation of a false frame that lifts the fixture. The brackets slide between the T-bar and the existing fixture. The bracket is also slightly wider than the T-bar opening. The door frame will keep the brackets spaced wide enough to ensure that the assembly would not fall out of the opening. The hinge and latch mechanism for the door frame is built into its end rails and latches onto the bracket to ensure the door frame is supported and held in position.

In one embodiment of the present invention there is provided, a pair of brackets for use with a recessed lighting fixture in a ceiling having inverted T-bar grid. The recessed lighting fixture would typically include a fixture body positioned against the inverted T-bar grid that supports the recessed lighting fixture. The fixture body has a pair of ends and two sides connecting the pair of ends. The recessed lighting fixture further includes a lighting cover having a pair of frame ends, each frame end of the lighting cover includes at one position a cam latch and at another position an extension hinge. The embodiment improvements are defined in the pair of bracket that are separately positioned between each end of the recessed lighting fixture and the inverted T-bar grid. Each bracket has a first means for securing the pair of brackets between the T-bar grid and the pair of ends of the fixture body, a second means for supporting the lighting cover about the extension hinges such that the lighting cover is capable of sliding about the extension hinges along the second means for supporting from a first end of the bracket to a second end of the bracket, and a third means for securing the cam latch, defined by each frame end of the lighting cover, against the bracket such that the lighting cover is secured to the brackets and thus the T-bar grid.

In various aspects of the embodiment, structural components of the means for elements are found in the combination of the bracket structure and the surrounding structural connections. For example, when each of the brackets is defined as having the below structural elements:

- first and second ends diametrically opposed from each other, the first and second ends being connected by a longitudinal extending base portion and top portion,
- a back side portion connecting the top portion to the base portion,
- a front side portion being opposite the back side portion and extending from the base portion towards the top portion stopping short of connecting to the top portion such that a longitudinal slot is formed between the front side portion and the top portion, the front side portion further including about each end thereof an upwardly extending flange member,
- a pair of tab members separately extending from the base portion at each of the first and second ends, each of the tab members, of the pair of tab members, having a first tab portion extending outwardly past the back side portion and having a second tab portion extending outwardly past the base portion, and
- one or more latch openings defined on the top portion and positioned to receive a portion of the cam latch defined by the frame end of the lighting cover the means language is defined by interconnections of structural elements.

The first means for securing the pair of brackets between the T-bar grid and the pair of ends of the fixture body, is defined by separately placing the pair of brackets against the pair of ends of the fixture body, such that the pair of tab members extending from each bracket is positioned between a portion of the T-bar grid and the end of the fixture body. The second means for supporting the lighting cover about the extension hinges is defined by having the extension hinges positioned within the longitudinal slot formed between the front side portion and the top portion of the bracket, wherein the lighting cover being supported by placing the extension hinges within the longitudinal slot is capable of sliding along the front side portion of the bracket until the extension hinges comes into contact with one of the upwardly extending flange members defined from the front side portion. And the third means for securing the cam latch is defined by having the one or more latch openings defined on the top portion being positioned to receive a portion of the cam latch defined by the frame end of the lighting cover.

In other aspects of the embodiment, each of the tab members include a detent extending from an underside surface of the tab members; and/or the front side portion further includes padding material secured to an outwardly defined face. In yet further aspects, the first means of securing further includes providing openings along the back side portion being sized to receive a fastening means that secures the bracket against a portion of the fixture body.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figures 1, 2, 3:
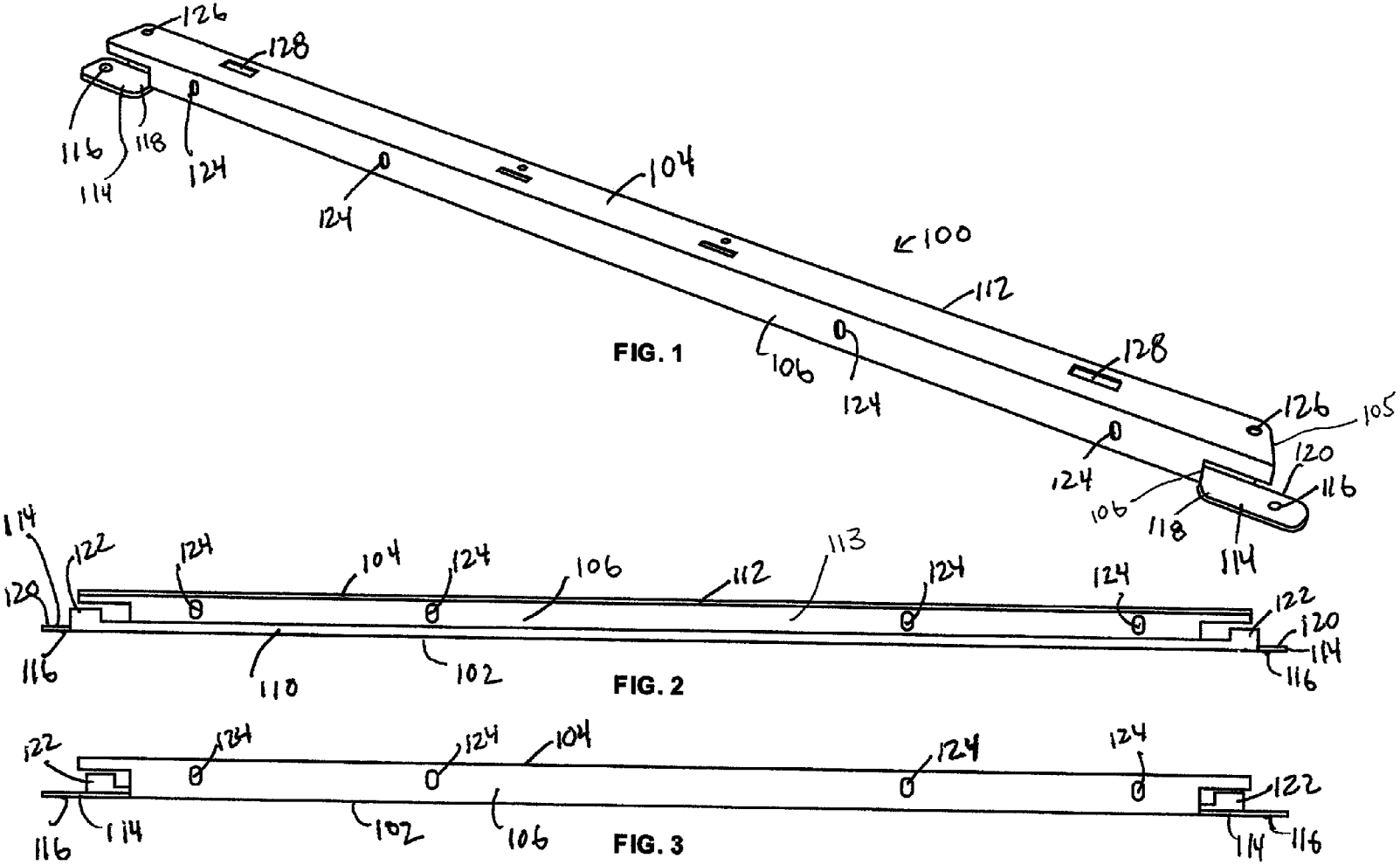
FIG. 1 is a rear perspective view of an adapter bracket for a light fixture in accordance with an embodiment of the invention.
FIG. 2 is a front view of the adapter bracket of FIG. 1.
FIG. 3 is a rear view of the adapter bracket of FIG. 1.
Figure 4:
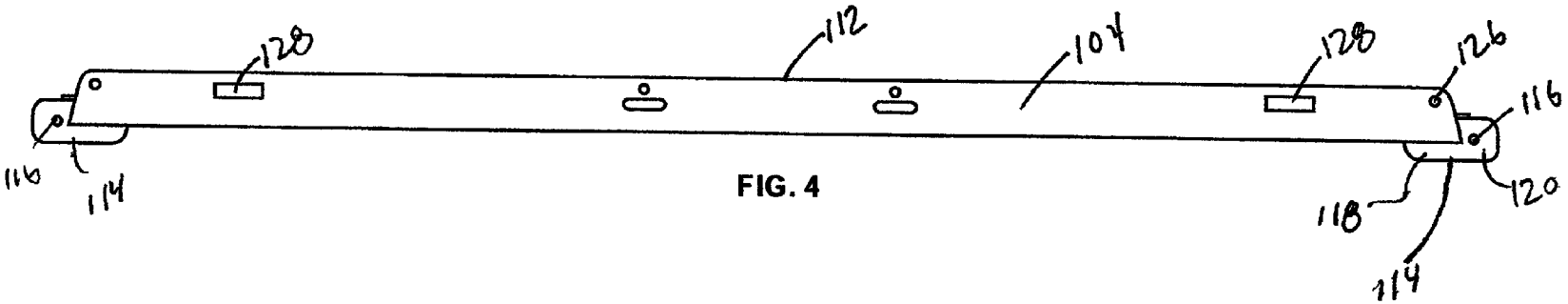
FIG. 4 is top view of the adapter bracket of FIG. 1.
Figure 5:
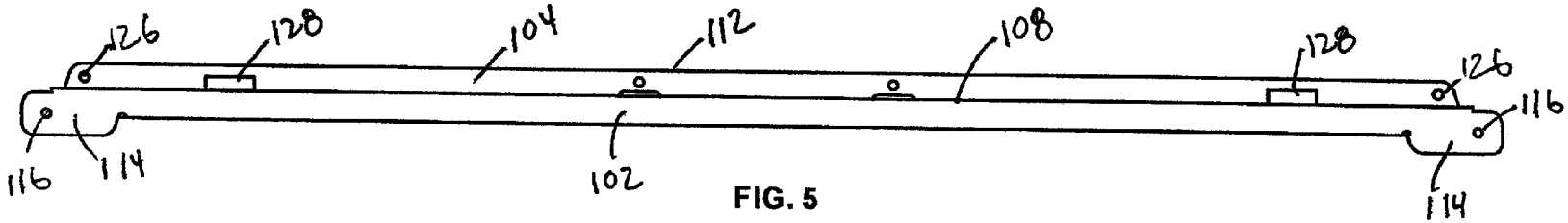
FIG. 5 is a bottom view of the adapter bracket of FIG. 1.
Figure 6:
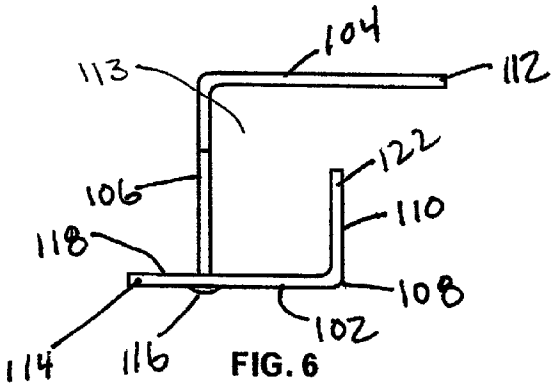
FIG. 6 is a side view of the adapter bracket of FIG. 1.
Figure 7:
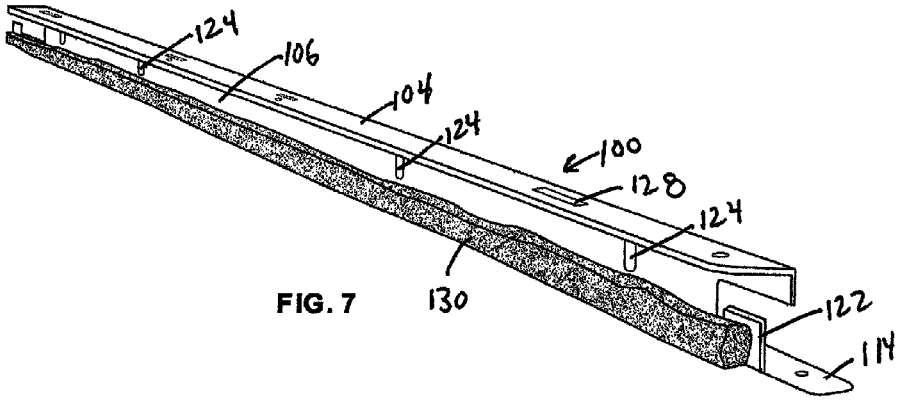
FIG. 7 is a front perspective view of an adapter bracket having a padding or soft material affixed to a front portion of the bracket in accordance with another embodiment of the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIGS. 1-7 there is shown an adapter bracket 100 used in connection with one or more embodiments of the present invention. The adapter bracket 100, as described and shown herein, enables the installation of a door frame or louver into a recessed fixture that sits on a T-bar supported by a ceiling. The adapter bracket 100 eliminates the need to custom design a hinge and latch system to match the original fixture and eliminates the need to install a false frame that lifts the fixture. The installation and proper use of the adapter bracket 100 is discussed in greater detail herein below.

The adapter bracket 100 has a base portion 102 and a top portion 104 opposite the base portion 102. The base portion 102 and top portion 104 are connected with a back side portion 106. Extending from a leading edge 108 of the base portion 102 is a front side portion 110. The front side 110 does not extend or connect the leading edge 108 of the base portion 102 to the edge 112 of the top portion 104. This configuration creates a hollowed region 113 between the base and top portions and between the back and front side portions and permits access to the hollowed region from the front side portion 110.

The base portion 102 includes a pair of tab members 114 separately extending from the ends of the base portion 102. The tab members are sized such that visually the tab members include a first portion 118 that extends outwardly beyond the back side portion 106 and a second portion 120 that extends outwardly beyond the end 105 of the top portion 104.

The tab members 114 each include a detent 116 that extends from the underside of the tab members 114. As shown from the top of each tab members 114, the detents 116 would appear has indentations. Preferably, the detents are stamped or marked from the adapter bracket 100 which is manufactured from a rigid metal. However, other materials may be used such as plastics, hybrid materials, etc.

The front side portion 110 includes at each end an upwardly extending flange member 122. As explained in greater detail the flange member 122 acts as a stop to help prevent the door frame from being moved too far to one side.

The back side portion 106 includes spaced apart openings 124 to allow the bracket to be secured into position by screws or any other type of fastening device. Openings 126 may also be provided about the ends of the top portion 104, as a means to further secure the bracket 100 to a lighting fixture, although these openings 126 are not strictly necessary.

The top portion 104 further includes one or more latch openings 128. The latch openings 128 are positioned to receive a portion of the latch mechanisms already installed on the door frame and are provided to secure the door frame in the closed position.

The bracket 100 may also include a pad or padding material 130 (FIG. 7) secured against the front side portion 110 to help protect a door frame from scratches and/or help provide a tighter fit between the bracket and the door frame to limit or eliminate the possibility of light seeping or escaping between the two.

Figure 14:
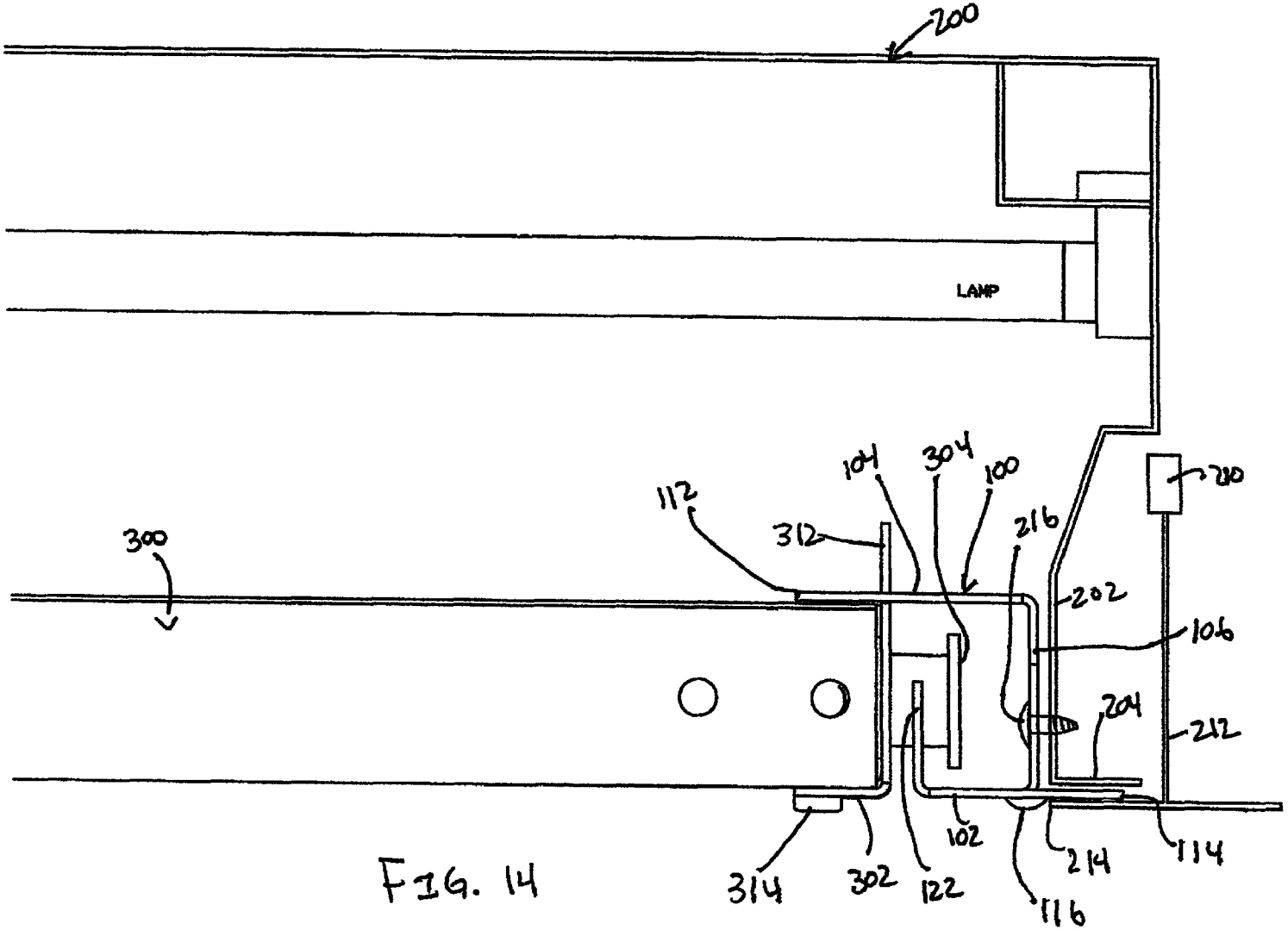
FIG. 14 is an enlarged cross side view of one end of the adapter bracket and louver or door frame.

Referring now also to FIGS. 8 through 14, the installation and use of the bracket 100 will be described in greater detail. In one embodiment the existing lighting fixture which includes an existing door frame or louver, ballast cover, lamp holder brackets and ballasts are removed in order to provide room for a lighting system. However, the existing lighting fixture may be used in other embodiments. If the lighting system is removed, a new lighting system is replaced. In either place, a bracket 100 in accordance with the teaching of the present invention is positioned between the fixture body 200 and a T-bar 210 and will typically fit snugly all the way back against the T-bar cross member 212. The tab members 114 would fit against the T-bar cross member 212, however, the enlarged view in FIG. 14 shows a slight space that may or may not be present in the installation.

Figure 8:
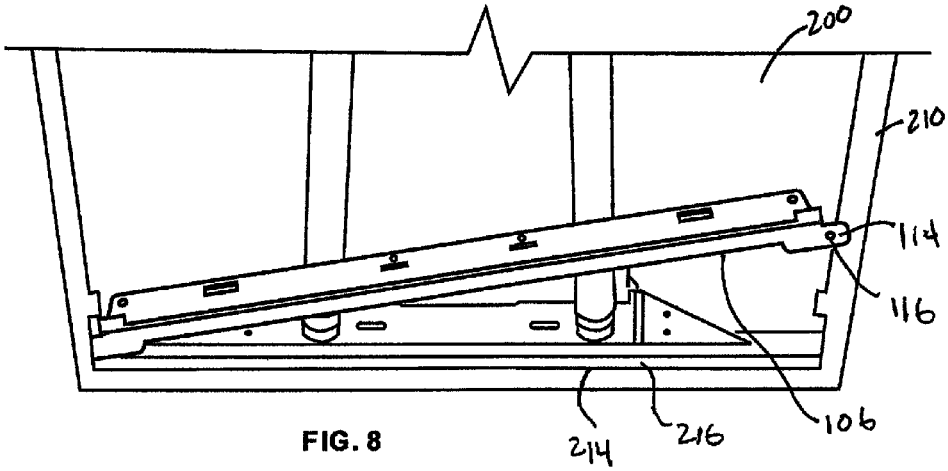
FIGS. 8-9 are perspective views of an adapter bracket being installed between a lighting fixture body and a T-bar grid in accordance with the present invention.
Figure 9:
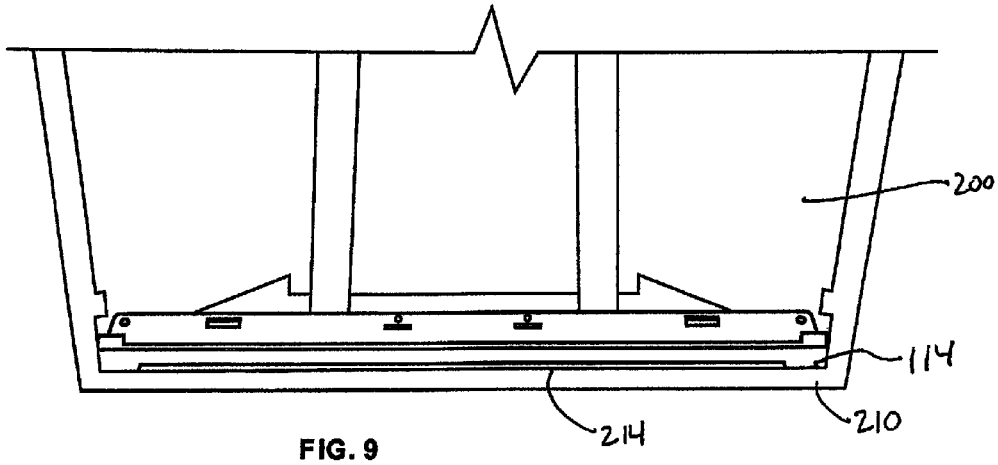

Continuing to refer to FIGS. 8 and 9, the tab members 114 are slide between the T-bar 210 and a bottom section 204 of the fixture body 200 such that the back side portion 106 of the bracket 100 is positioned against a front side section 202 of the fixture frame 200. The detent 116 may also be used to help determine how far back the bracket 100 is positioned; since as the bracket 100 is installed, a portion of the detent 116 may come into contact with a front edge 214 of the T-bar 210. Once the bracket 100 is positioned, screws 216 or other types of fasteners may be used to secure the bracket against the T-bar 210. In addition, the bracket is also slightly wider than the T-bar opening. The louver or door frame will keep the brackets spaced wide enough to ensure that the assembly would not fall out of the opening.

Figure 10:
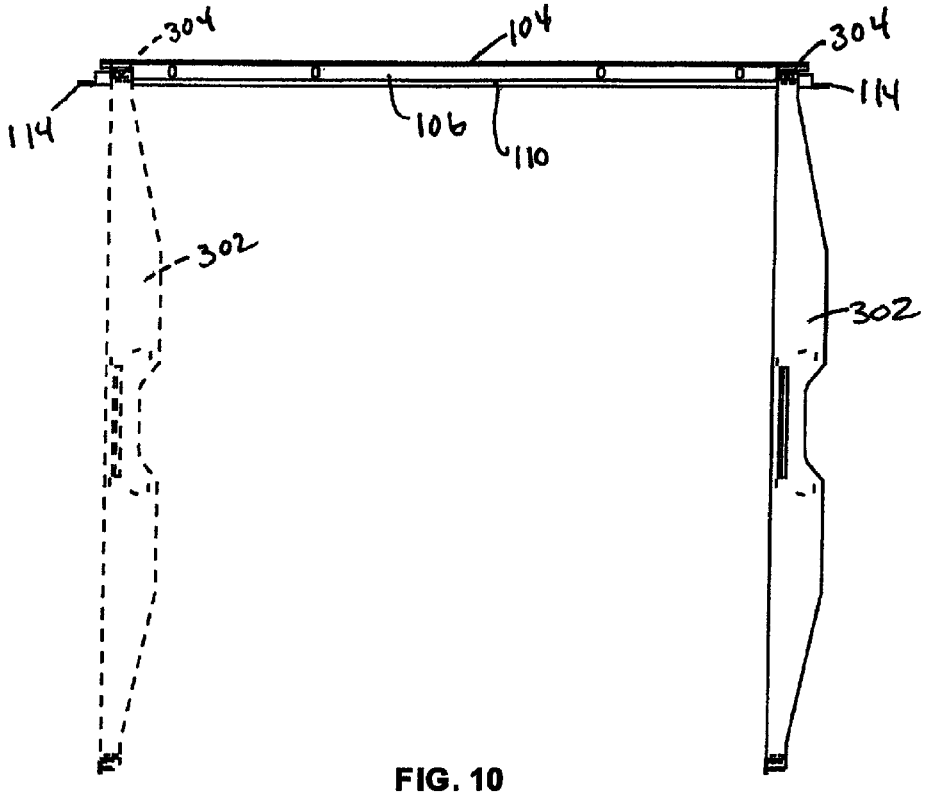
FIGS. 10-11 are side views of an adapter bracket in use with an end of a louver or door frame in accordance with the present invention.
Figure 11:
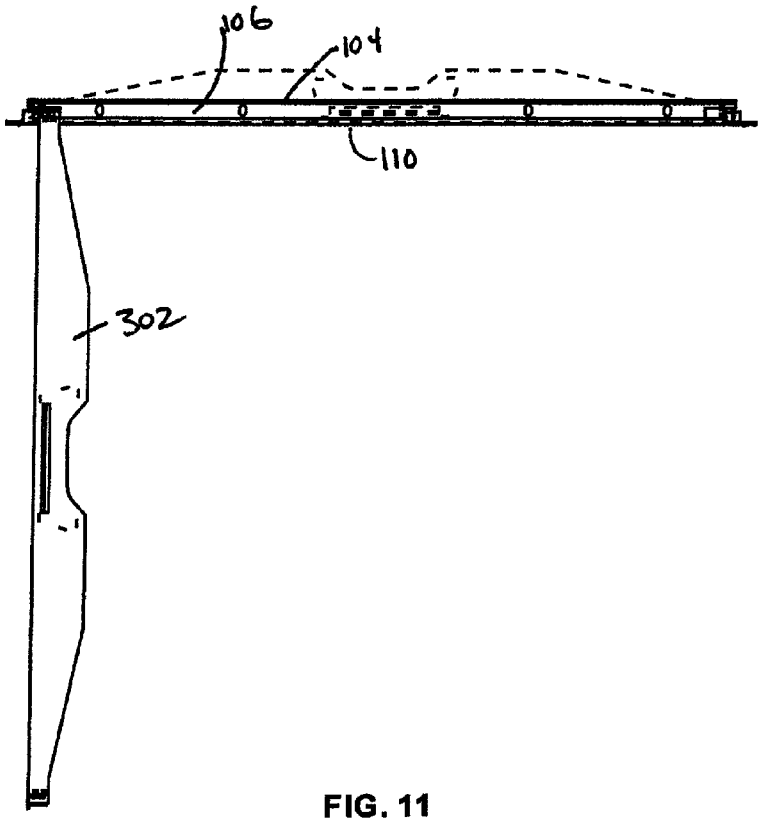

Referring now also to FIGS. 10-11, the installation of the louver or door frame is discussed in greater detail. The end sections 302 of each louver or door frame 300 include an extension hinge 304 protruding from one end of the frame 300. During installation the extension hinge 304 is capable of hanging on the front side portion 110 of the bracket 100. The louver or door frame 300 may then slide from one end of the bracket to the other end of the bracket, until the extension leg 304 comes into contact with the flange member 122 (FIG. 10). Once the louver or door frame 300 is in the proper positioned against the flange member 122, it may be swung upwardly (FIG. 11).

Figure 12A:
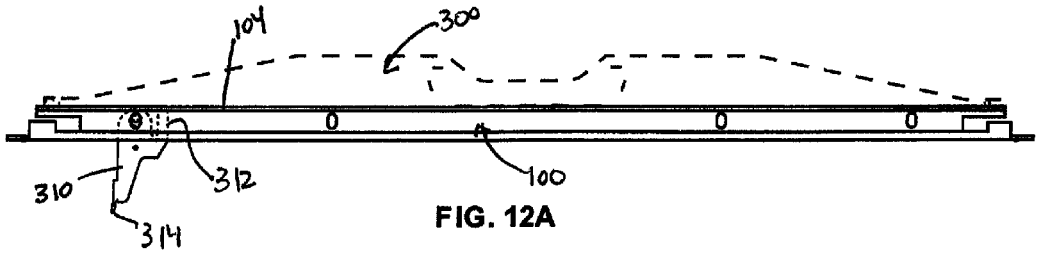
FIGS. 12A and 12B are side views of the adapter bracket in use with an end of a louver or door frame showing a cam latch fixed to the louver or door frame being positioned to lock the louver or door frame to the adapter bracket.
Figure 12B:
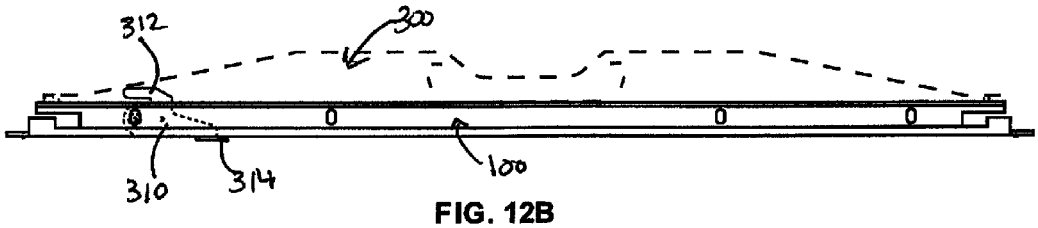
Figure 13:
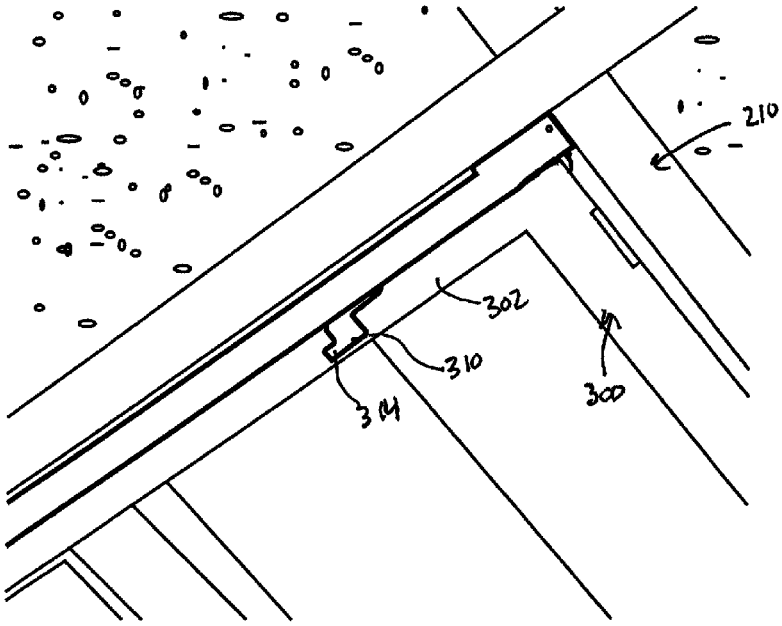
FIG. 13 is a perspective view of an adapter bracket and louver or door frame assembled together with a lighting fixture.

The louver or door frame 300 is then secured into position. As shown in FIGS. 12A and 12B, the end section 302 includes a cam latch 310. The cam latch 310 includes a latch 312 extending upwardly and outwardly above the louver or door frame and includes a flange 314 on the below the louver or door frame. During installation, the cam latch 310 is shifted to an unlocked position which pivots or places the latch 312 below the top portion 104 of the bracket 100. Once in position, the flange 314 is pressed towards the louver or door frame which causes the latch 312 to rotate through a latch opening 128 on the top portion 104 of the bracket 100. The same may then be done on the opposite side of the louver or door frame end.

To remove the louver or door frame, the user may pull the flanges 314 on each of the cam latches 310 away from the louver or door frame, to rotate or pivot the latches 312 out of the latch openings 128. This permits the user to remove the louver or door frame easily and provides the user to remove and replace lights or louver or door frames without disruption of ceiling tiles or wires.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. A pair of brackets for use with a recessed lighting fixture in a ceiling having inverted T-bar grid, the recessed lighting fixture having a fixture body positioned against the inverted T-bar grid for supporting the recessed lighting fixture, the fixture body having a pair of ends and two sides connecting the pair of ends, the recessed lighting fixture further including a lighting cover having a pair of frame ends, each frame end of the lighting cover defined to include at one position a cam latch and at another position an extension hinge, the improvement comprising:

the pair of brackets being separately positioned between each end of the recessed lighting fixture and the inverted T-bar grid, each bracket, from the pair of brackets, having:

a first means for securing the pair of brackets between the T-bar grid and the pair of ends of the fixture body, a second means for supporting the lighting cover about the extension hinges such that the lighting cover is capable of sliding about the extension hinges along the second means for supporting from a first end of the bracket to a second end of the bracket, and a third means for securing the cam latch, defined by each frame end of the lighting cover, against the bracket such that the lighting cover is secured to the brackets and thus the T-bar grid.

2. The brackets of claim 1, wherein each of the brackets, of the pair of brackets, is further defined as having:

first and second ends diametrically opposed from each other, the first and second ends being connected by a longitudinal extending base portion and top portion, a back side portion connecting the top portion to the base portion, a front side portion being opposite the back side portion and extending from the base portion towards the top portion stopping short of connecting to the top portion such that a longitudinal slot is formed between the front side portion and the top portion, the front side portion further including about each end thereof an upwardly extending flange member, a pair of tab members separately extending from the base portion at each of the first and second ends, each of the tab members, of the pair of tab members, having a first tab portion extending outwardly past the back side portion and having a second tab portion extending outwardly past the base portion, and one or more latch openings defined on the top portion and positioned to receive a portion of the cam latch defined by the frame end of the lighting cover.

3. The brackets of claim 2, wherein the first means for securing the pair of brackets between the T-bar grid and the pair of ends of the fixture body, is defined by separately placing the pair of brackets against the pair of ends of the fixture body, such that the pair of tab members extending from each bracket is positioned between a portion of the T-bar grid and the end of the fixture body.

4. The brackets of claim 2, wherein the second means for supporting the lighting cover about the extension hinges is defined by having the extension hinges positioned within the longitudinal slot formed between the front side portion and the top portion of the bracket, wherein the lighting cover being supported by placing the extension hinges within the longitudinal slot is capable of sliding along the front side portion of the bracket until the extension hinges comes into contact with one of the upwardly extending flange members defined from the front side portion.

5. The brackets of claim 2, wherein the third means for securing the cam latch is defined by having the one or more latch openings defined on the top portion being positioned to receive a portion of the cam latch defined by the frame end of the lighting cover.

6. The brackets of claim 2, wherein each of the tab members include a detent extending from an underside surface of the tab members.

7. The brackets of claim 2, wherein the front side portion further includes padding material secured to an outwardly defined face.

8. The brackets of claim 3, wherein the first means of securing further includes providing openings along the back side portion being sized to receive a fastening means that secures the bracket against a portion of the fixture body.

9. In combination with a recessed lighting fixture in a ceiling having inverted T-bar grid, the recessed lighting fixture having a fixture body positioned against the inverted T-bar grid for supporting the recessed lighting fixture, the fixture body having a pair of ends and two sides connecting the pair of ends, the recessed lighting fixture further including a lighting cover having a pair of frame ends, each frame end of the lighting cover defined to include at one position a cam latch and at another position an extension hinge, at least one bracket positioned between an end of the recessed lighting fixture and the inverted T-bar grid, the at least one bracket further comprising:

first and second ends diametrically opposed from each other, the first and second ends being connected by a longitudinal extending base portion and top portion;

a back side portion connecting the top portion to the base portion;

a front side portion being opposite the back side portion and extending from the base portion towards the top portion stopping short of connecting to the top portion such that a longitudinal slot is formed between the front side portion and the top portion, the front side portion further including about each end thereof an upwardly extending flange member;

a pair of tab members separately extending from the base portion at each of the first and second ends, each of the tab members, of the pair of tab members, having a first tab portion extending outwardly past the back side portion and having a second tab portion extending outwardly past the base portion; and one or more latch openings defined on the top portion and positioned to receive a portion of the cam latch defined by the frame end of the lighting cover.

10. The combination of claim 9 further comprising a first means for securing the at least one bracket between the T-bar grid and the pair of ends of the fixture body, the first means defined by separately placing the at least one bracket against an end of the fixture body, such that the pair of tab members extending from the at least one bracket is positioned between a portion of the T-bar grid and the end of the fixture body.

11. The combination of claim 9 further comprising a second means defined by the at least one bracket for supporting the lighting cover about the extension hinges such that the lighting cover is capable of sliding about the extension hinges along the second means for supporting from a first end of the at least one bracket to a second end of the at least one bracket, the second means defined by having the extension hinges positioned within the longitudinal slot formed between the front side portion and the top portion of the at least one bracket, wherein the lighting cover being supported by placing the extension hinges within the longitudinal slot is capable of sliding along the front side portion of the at least one bracket until the extension hinges comes into contact with one of the upwardly extending flange members defined from the front side portion.

12. The combination of claim 9 further comprising a third means for securing the cam latch defined by each frame end of the lighting cover, against the at least one bracket such that the lighting cover is secured to the at least one bracket and thus secured to the T-bar grid, the third means defined by having the one or more latch openings defined on the top portion being positioned to receive a portion of the cam latch defined by the frame end of the lighting cover.

* * * * *